US007025022B2

(12) United States Patent
Bortone

(10) Patent No.: US 7,025,022 B2
(45) Date of Patent: Apr. 11, 2006

(54) EXHAUST VALVE AND INTAKE SYSTEM

(76) Inventor: Cesare Bortone, Via Antonello Coniger 14, Lecce 73 100 (IT)

( * ) Notice: Subject to any disclaimer, the term of this patent is extended or adjusted under 35 U.S.C. 154(b) by 0 days.

(21) Appl. No.: 10/182,378

(22) PCT Filed: Jun. 28, 2001

(86) PCT No.: PCT/IT01/00343

§ 371 (c)(1),
(2), (4) Date: Oct. 29, 2002

(87) PCT Pub. No.: WO02/01053

PCT Pub. Date: Jan. 3, 2002

(65) Prior Publication Data

US 2003/0101950 A1 Jun. 5, 2003

(30) Foreign Application Priority Data

Jun. 29, 2000 (IT) ..... LE2000A0014

(51) Int. Cl.
*F01L 1/34* (2006.01)

(52) U.S. Cl. ..... 123/90.15; 123/90.17; 123/61 V; 123/568.11

(58) Field of Classification Search ..... 60/278, 60/286, 605.2; 123/56.3, 45 A, 190.1, 90.15, 123/90.16, 90.17, 90.18, 568.11, 568.14, 123/43 R, 44 C
See application file for complete search history.

(56) References Cited

U.S. PATENT DOCUMENTS

| | | | | |
|---|---|---|---|---|
| 3,786,790 | A * | 1/1974 | Plevyak | 123/56.2 |
| 4,013,048 | A * | 3/1977 | Reitz | 123/55.7 |
| 4,090,478 | A * | 5/1978 | Trimble et al. | 123/56.9 |
| 4,516,536 | A * | 5/1985 | Williams | 123/39 |
| 4,736,715 | A * | 4/1988 | Larsen | 123/64 |
| 4,887,558 | A * | 12/1989 | Bernard | 123/57.1 |
| 5,803,042 | A * | 9/1998 | Bortone | 123/312 |
| 6,237,336 | B1 * | 5/2001 | Feucht et al. | 60/605.2 |

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

A method for controlling a fluid quantity in an internal combustion engine is provided for an internal combustion engine having an engine shaft and an operation cycle that includes at least one intake phase, one proportioning phase, one combustion phase in a combustion chamber of the engine, an engine intake system, an exhaust system having a duct for removing fluid from the combustion chamber, and a timing system to control an opening and a closing of the exhaust system duct. The method includes keeping an exhaust valve open for an adjustable time length in an initial part of the intake, proportioning and compressing phase and entering an amount of fuel corresponding to the amount of air remaining in the compression chamber after closing the exhaust valve in a subsequent part of the intake, portioning and compression phase.

5 Claims, 12 Drawing Sheets

EXHAUST VALVE AND INTAKE SYSTEM

This application is the national phase under 35 U.S.C. § 371 of PCT International Application No. PCT/IT01/00343 which has an International filing date of Jun. 28, 2001, which designated the United States of America.

BACKGROUND OF THE INVENTION

1. Field of the Invention

The present invention relates to an internal combustion engine, and more particularly to an exhaust valve and intake system for an internal combustion engine.

2. Description of the Background Art

Only four types of engines have been applied on large scale in the history of engines, including the four stroke engine, the two stroke engine, the Wankel engine, and the gas turbine. Although other engines and power sources like the electric engine, the steam engine, the Stirling engine and fuel-cells are available, the actual level of their development does not allow these alternatives to adequately compete with the internal combustion engines described hereinabove because of the excessive production costs, inefficiency or low functionality.

In the 1970s, the gas turbine seemed able to replace the classic four stroke engine in automotive applications, owing to the gas turbine's simplicity and relatively narrow dimensions. Further, in aeronautical applications, the gas turbine engine has proven to have a better efficiency than alternatives, demonstrated little vibration, operated relatively clean, and was relatively durable and powerful. On the other hand, the acceptable efficiency could be reached only with very high temperatures in the combustion chamber, so it was necessary to build the turbine with special materials, too expensive for a large scale production in automotive applications. Not even the Wankel has been capable of replacing the four stroke engine, even though it had similar prerogatives of the gas turbine without the prohibitive costs of construction, operation and maintenance. Even in this case, the chronic high consumption in addition to a reliability that was possible only recently have invalidated the complete success of the Wankel engine. Although the Wankel engine is still used in those applications in which the fuel consumption is a secondary parameter.

In contrast, the two stroke engine until a few years ago had a plurality of defects, i.e., including, but not limited to high fuel consumption, excessive emissions, irregular functioning at low rpm or idle speeds. However, the latest developments in two stroke engines show highly respectable efficiency and functionality, dimensions that are almost half the size for the same power output. Accordingly, there has been an increase in the motivation of designers to utilize two stroke engines in lieu of four stroke engines. Particularly, the two stroke diesel with the controllable opening of the exhaust system, or in hybrid applications an electric engine coupled with a small alternative internal combustion engine that works constantly at maximum rpm, are able to demonstrate good efficiency. However, these last alternatives are more expensive due to the added costs of the electric engine.

It is obvious that to obtain substantial evolution from an engine it is necessary to operate on various design parameters. For example, a reduction of more possible losses from the exhaust is desired, and/or a reduction in the wastes of the irradiation of heat, because the thermal rendering of alternative endothermal engines is very modest. Efficiency improvement at all rpm and at all the requests of power, e.g., at the maximum couple rpm, the internal friction of engines allows efficiencies of 0.8, but at moderate charges and rpm only a modest 0.55 of efficiency can be achieved. This assumes huge importance, if it is considered that in a life of a vehicle the engine is operated at 80% of capacity at the partial charges and low rpm.

Correct combustion in order to obtain benefits not only in terms of consumption and performances, but also for a reduction of emissions is also desired. An increase in engine versatility, the optimum would be to have the possibility to use the prime mover in different sectors, in the aeronautical fields, in the automotive field, and/or in the nautical field, etc.

The present inventor foresees an engine with total modularity of the block and of the heads, in order to have ample choice of power. Simplicity of the engine, that has no needs of complex or expensive working process nor precious materials. Easy maintenance, assembling and disassembling is desired along with an engine that is light and compact. The combination of some ideas, right after exposed, make possible to realize a new engine design that allows a concentration in the engine all the prerogatives and the improvements cited before, in a simple and compact structure, included in a block substantially cylindrical.

SUMMARY OF THE INVENTION

The present invention overcomes the shortcomings associated with the background art and achieves other advantages not realized by the background art.

A first aspect of the present invention utilized by the present inventor was thought of and experimented to obtain a method capable of obtaining the cleaning phase of the two stroke engine that takes advantage of the inertia of the air that is in the duct of the intake and that is recalled by the depression existing in the combustion chamber immediately after the moment of the exit of the exhaust gases. The method of the present invention provides considerable advantages in terms of efficiency and relieves the obligations to use turbines or compressors of various types generally used for the cleaning in internal combustion engine systems.

A second aspect of the present invention helps to solve the serious limitations of Kadanacy with a method that works only in a very small range of rpm. In the engine, a controlled annular exhaust valve is adopted, with ample and with adjustable times of valve lift as is needed. In both cases of the beginning and of the duration of the valve lift, this enables, at the end of the cleaning phase, to regulate the quantity of air that must be kept in the combustion chamber for the subsequent combustion.

In contrast to what happens with the throttling effects realized by the throttle in the duct of the intake, the air is free to enter copiously in the combustion chamber, but without any substantial excess. Accordingly, an optimal cleaning with all the charges and all the rotation operation is achieved.

A third aspect of the present invention is the adoption of a special shaft for the transformation of the alternate rectilinear movement of the pistons during rotation and that controls the sinusoidal camshaft adopted in the engines that had cylinders arranged coaxially around the shaft. However, the new special shaft differs for many aspects that concern the relief of the structures of the parts that are in alternative movement.

The possibility to regulate through an element of the shaft, the variation of compression ratio at all rotating operation and at all charges. The different planning of the lows of the alternative movement of the piston suggested by Prof. D.

Laforgia and Prof. M. Candeo, that carries out significant advantage like the reduction of the maximum and mean time velocities of the piston, e.g., obtained by the constant accelerations and decelerations of the pistons, that can, in addition, stop for a period at the top and bottom dead centers for better cleaning (scavenging) and combustion phases. The present invention provides a possibility to complete, in only one revolution of the shaft, three operative combustion cycles.

In addition, the adoption of annular pistons completes and facilitates in a new and more rational way the advantages until now appreciated with a strong, light and multifunctional structure useful for spark ignition combustion and for compressive ignition systems.

One or more of these and other aspects are further accomplished by a method for controlling a fluid quantity in an internal combustion engine, the internal combustion engine including an operation cycle that includes at least one intake phase, one proportioning phase, one combustion phase in a combustion chamber of the engine, an engine intake system, an exhaust system having a duct for removing fluid from the combustion chamber, and a timing system to control an opening and a closing of the exhaust system duct, the method keeping an exhaust valve open for an adjustable time length in an initial part of the intake, proportioning and compressing phase and entering an amount of fuel corresponding to the amount of air remaining in the compression chamber after closing the exhaust valve in a subsequent part of the intake, proportioning and compression phase.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
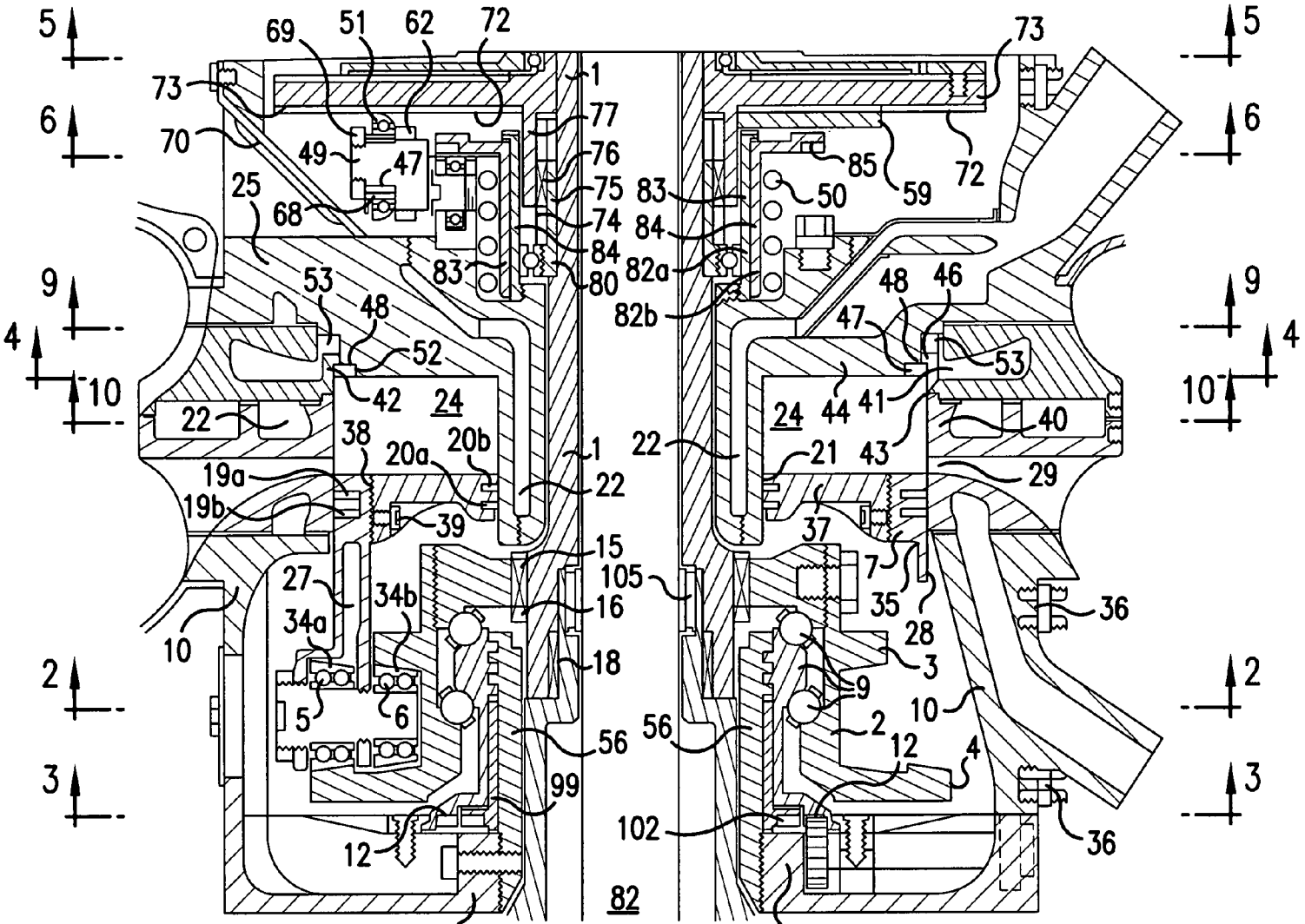
FIG. 1 is a side sectional view of an engine of the present invention that shows an assembly of a cylinder with an engine shaft that profiles an annular piston and valve and a controlling system of the phase and of the compression ratio.
Figure 2:
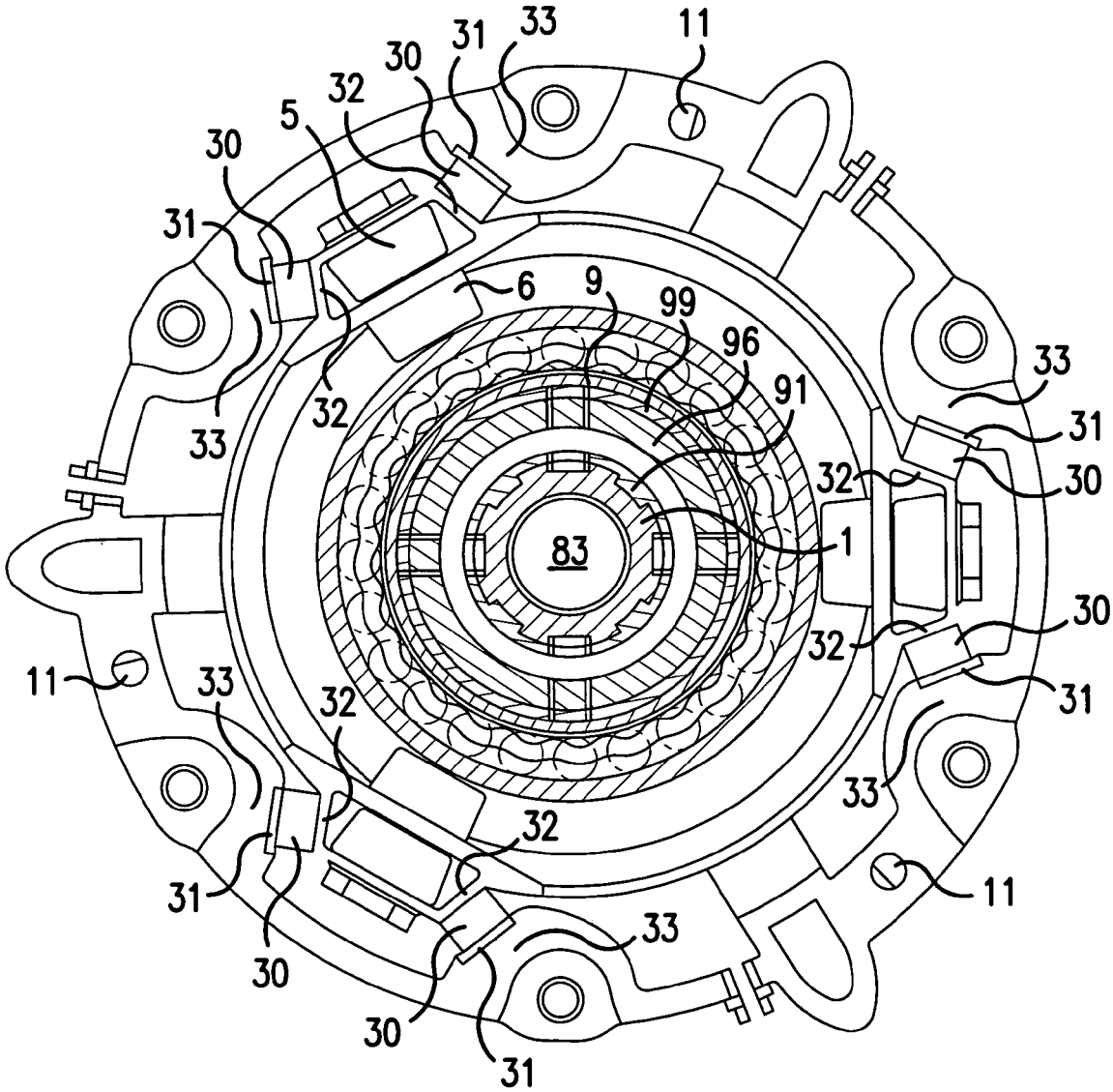
FIG. 2 is a partial, side sectional view taken along line 2–2 of FIG. 1 that shows an internal portion of the piston and ball bearings.
Figure 3:
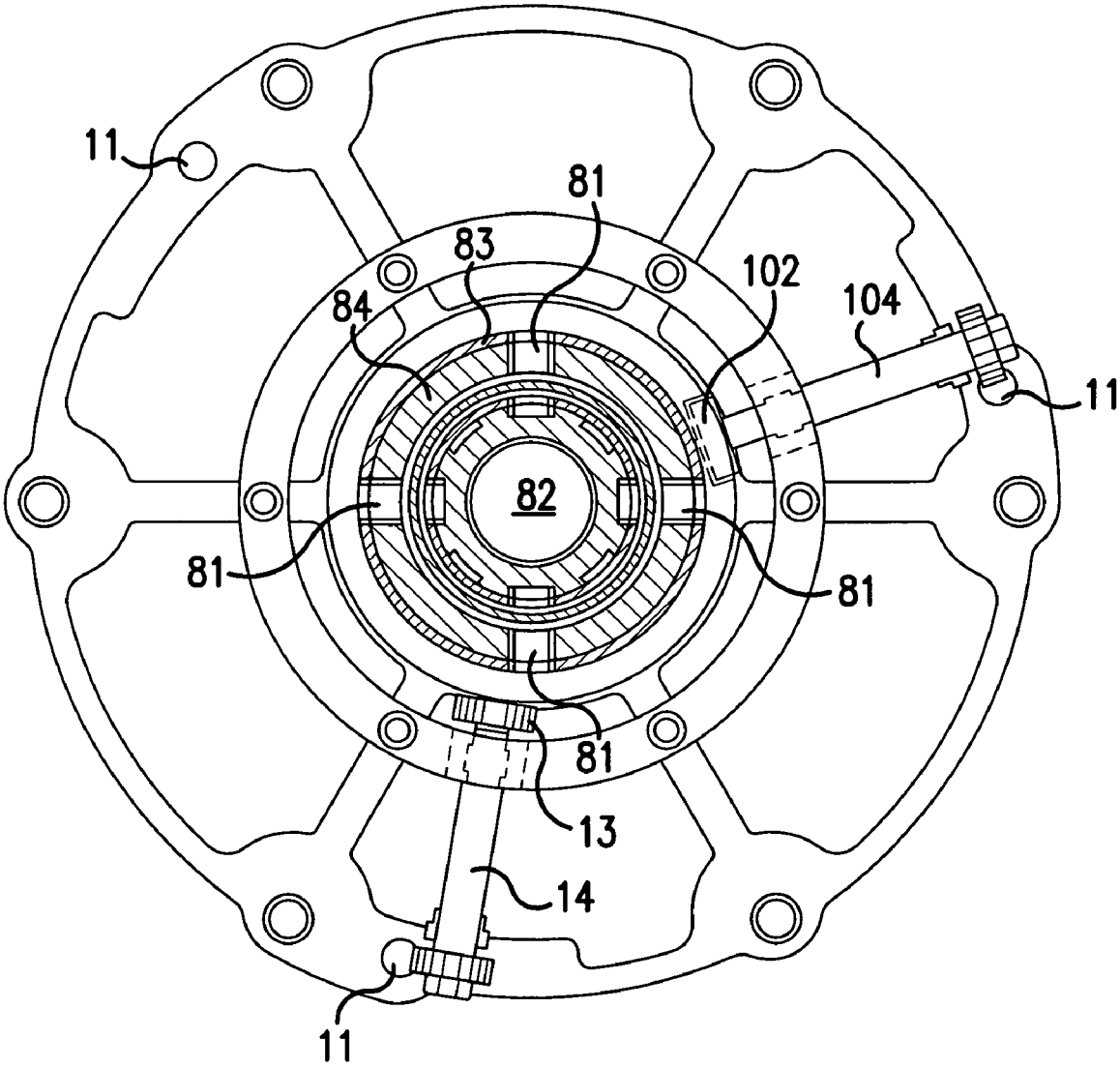
FIG. 3 is a partial sectional view taken along line 3—3 of FIG. 1 and showing a top portion of a superior head top or of the cylinder block.
Figure 4:
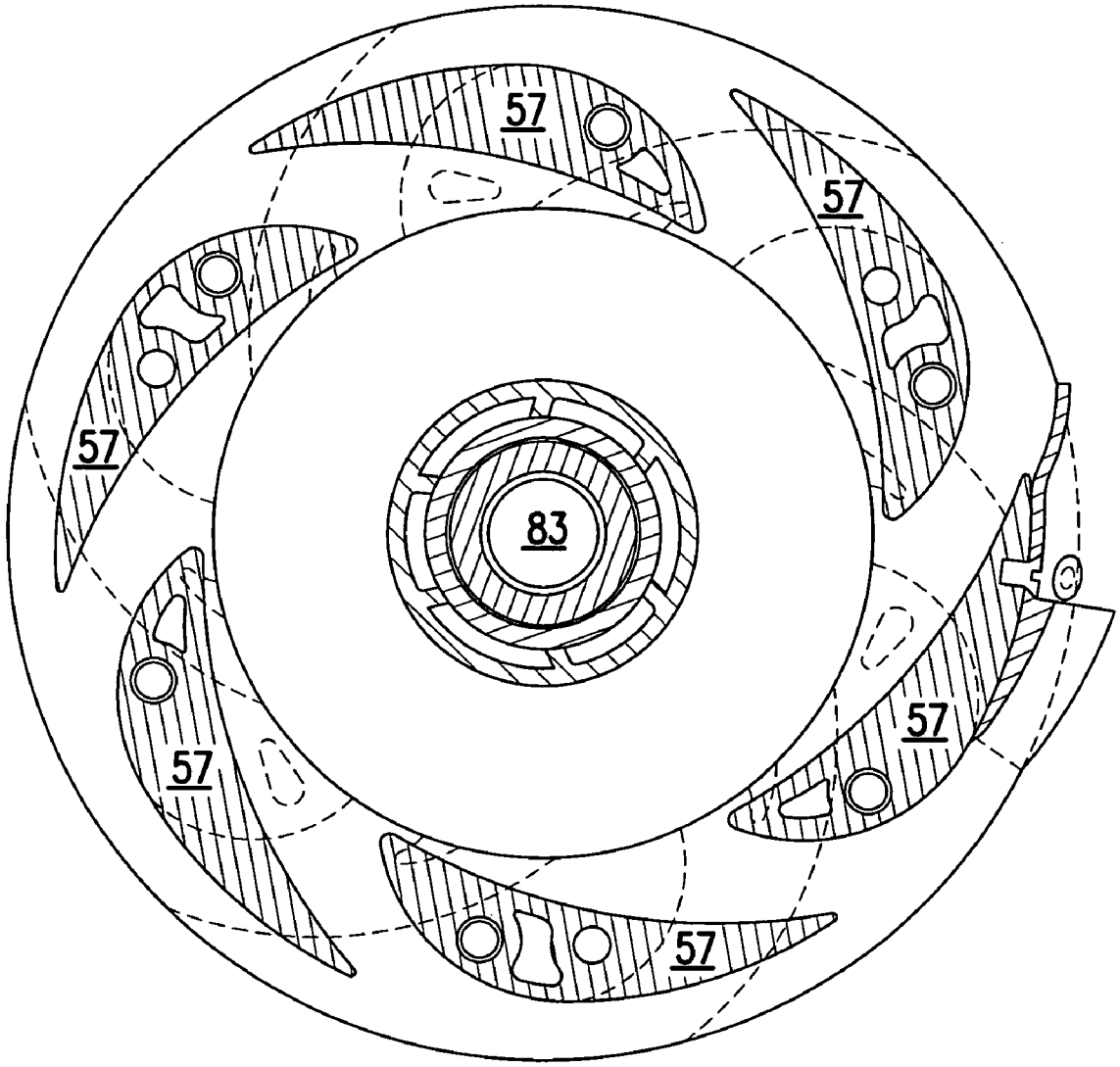
FIG. 4 is a sectional view taken along line 4—4 of FIG. 1 showing deflectors that guide the exhaust gas towards a relative duct and deflectors of the intake.

The present invention will hereinafter be described with reference to the accompanying drawings. FIG. 1 is a side sectional view of an engine of the present invention that shows an assembly of a cylinder with an engine shaft that profiles an annular piston and valve and a controlling system of the phase and of the compression ratio. FIG. 2 is a partial, side sectional view taken along line 2—2 of FIG. 1 that shows an internal portion of the piston and ball bearings. FIG. 3 is a partial sectional view taken along line 3—3 of FIG. 1 and showing a top portion of a superior head top or of the cylinder block. FIG. 4 is a sectional view taken along line 4—4 of FIG. 1 showing deflectors that guide the exhaust gas towards a relative duct and deflectors of the intake.

Figure 5:
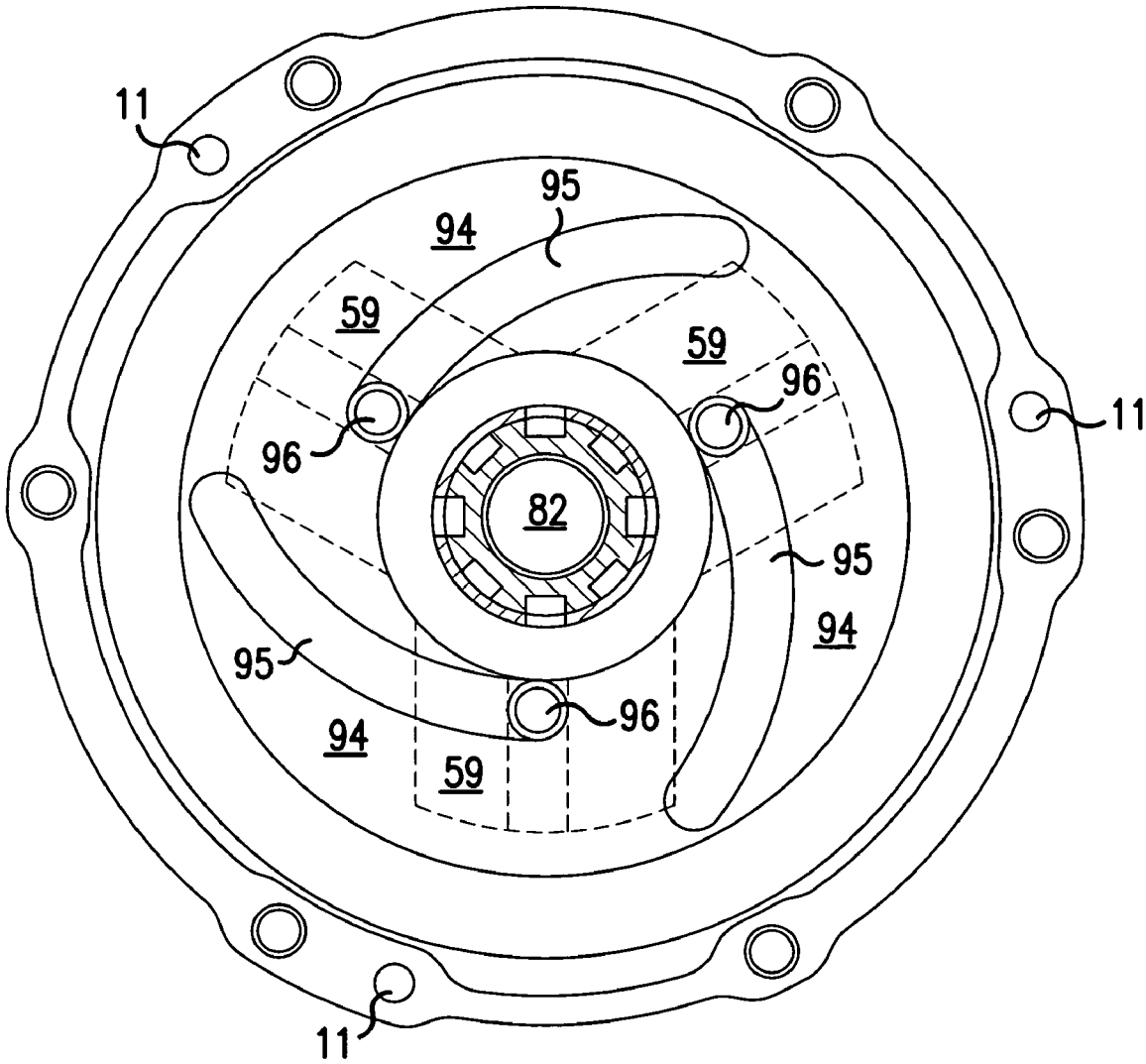
FIG. 5 is a partial, sectional view taken along line 5—5 of FIG. 1 showing a system for the variation of the pressure under a cover of the cylinder head.
Figure 6:
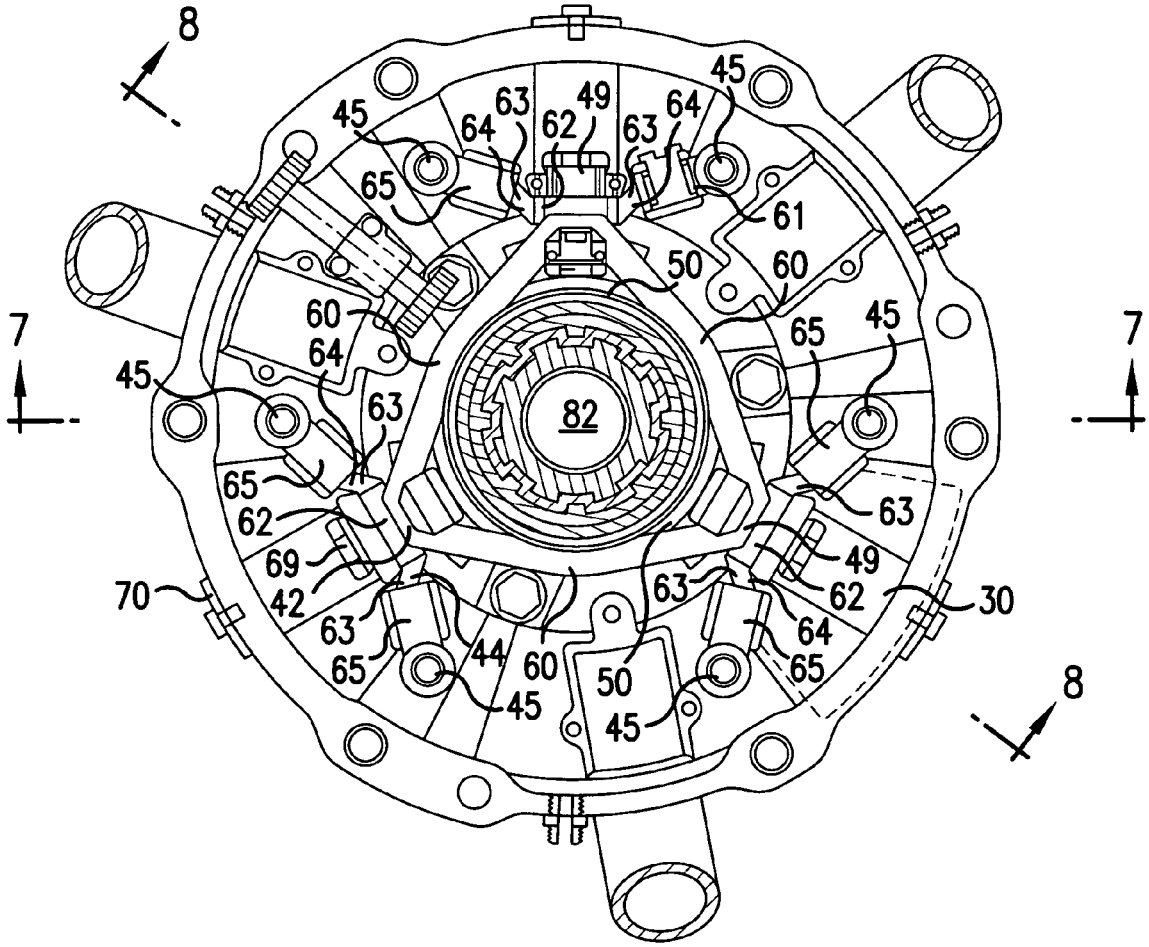
FIG. 6 is a partial, sectional frontal view of an engine of the present invention taken along line 6—6 of FIG. 1 and showing a structure with tappets engaged with a connecting portion.
Figure 7:
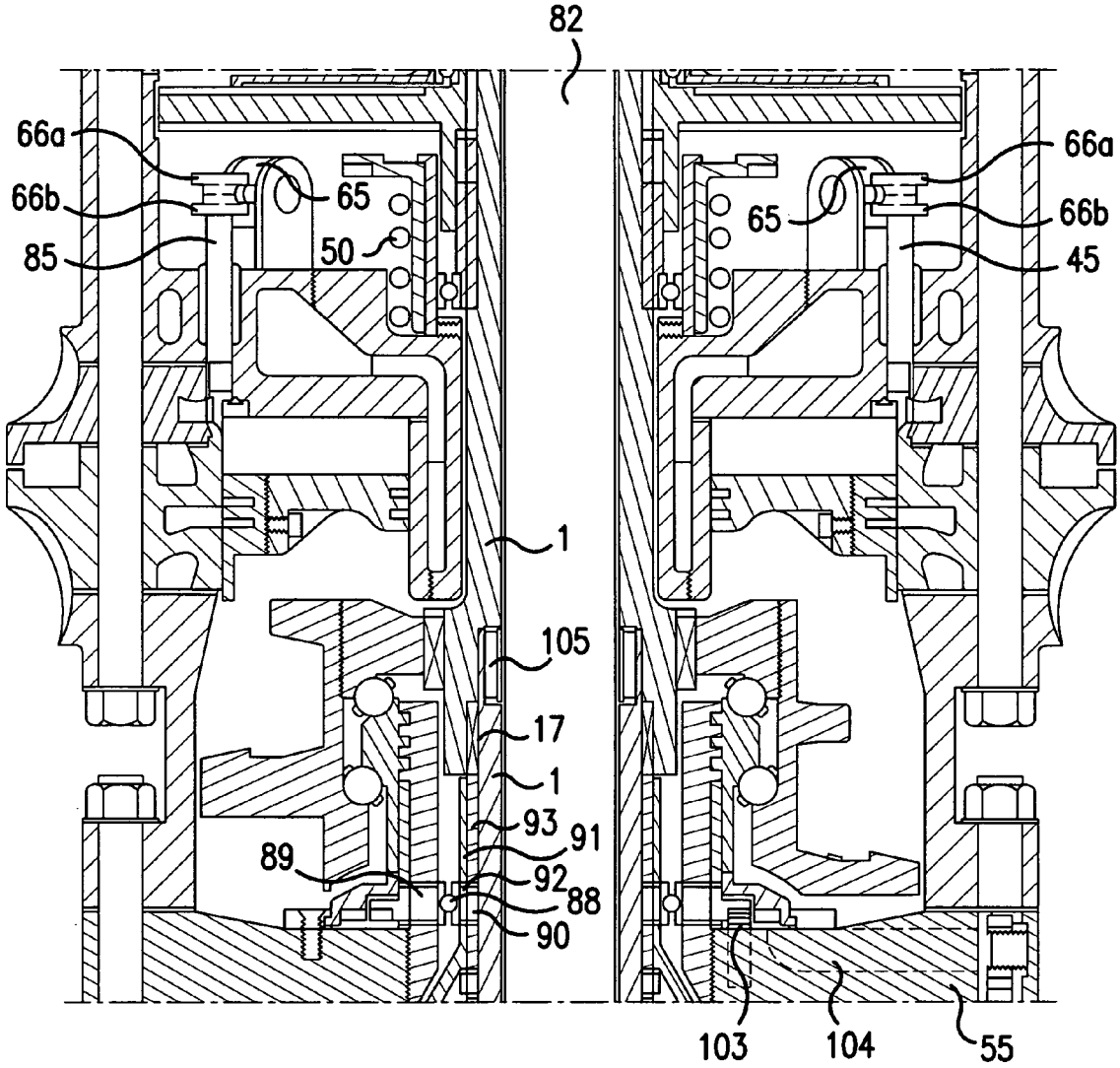
FIG. 7 is a side sectional view taken along line 7—7 of FIG. 6 that shows stems and relative connecting paths.
Figure 8:
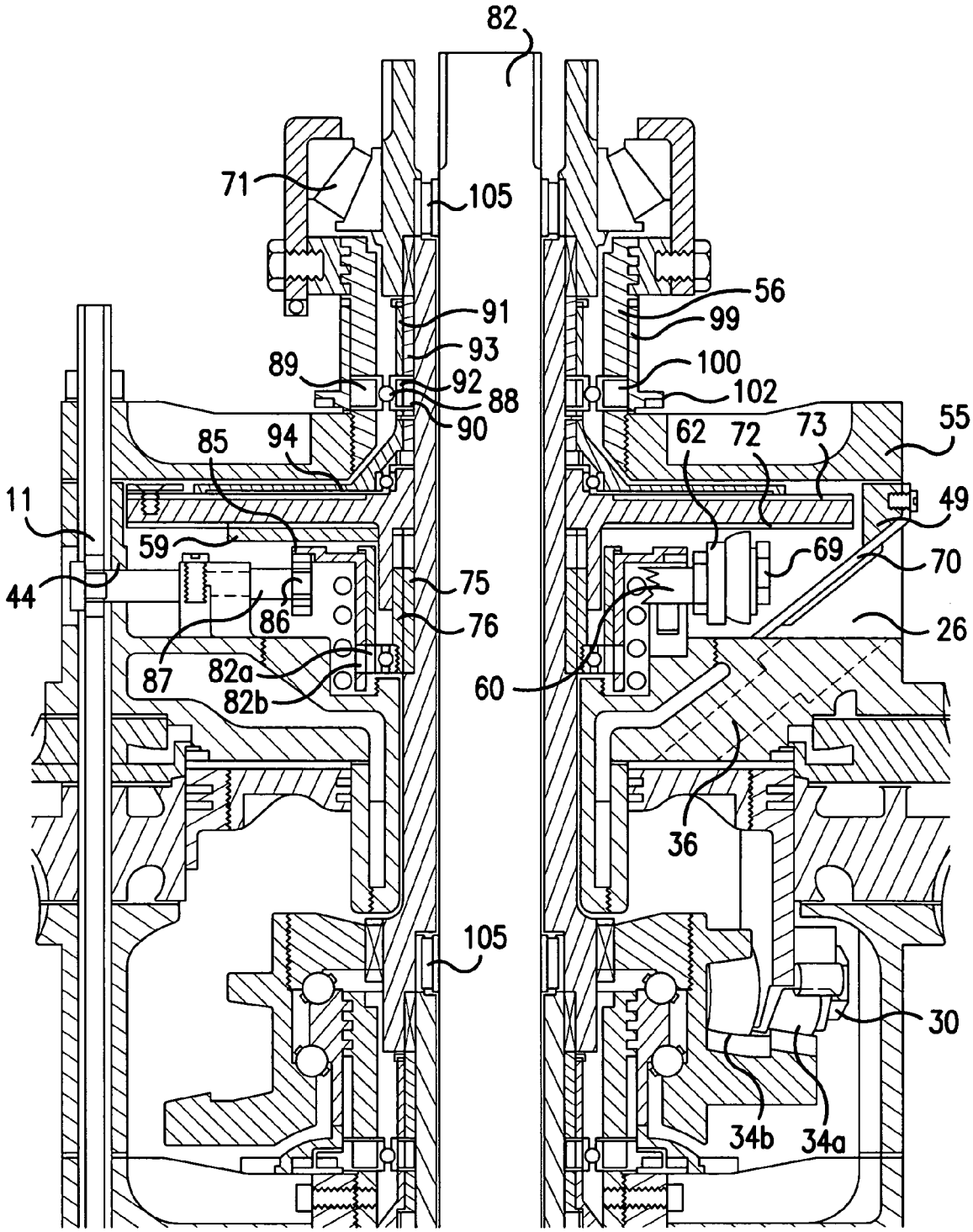
FIG. 8 is a side sectional view taken along line 8—8 of FIG. 6 showing a tappet and relative supporting structure, e.g., such as ball bearings and the guiding rollers of an annular-shaped piston.
Figure 9:
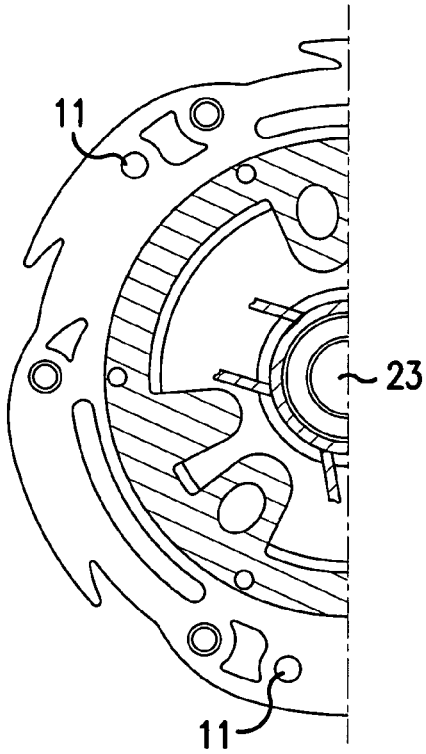
FIG. 9 is a partial sectional view taken along line 9—9 in FIG. 1.
Figure 10:
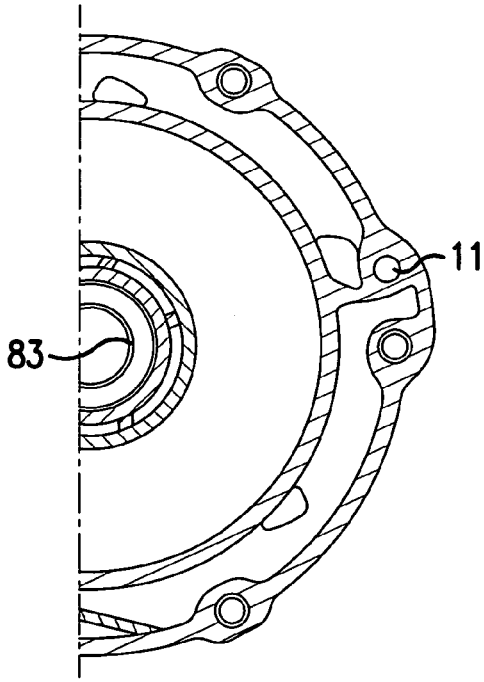
FIG. 10 is a partial sectional view taken along line 10—10 in FIG. 1.
Figure 11:
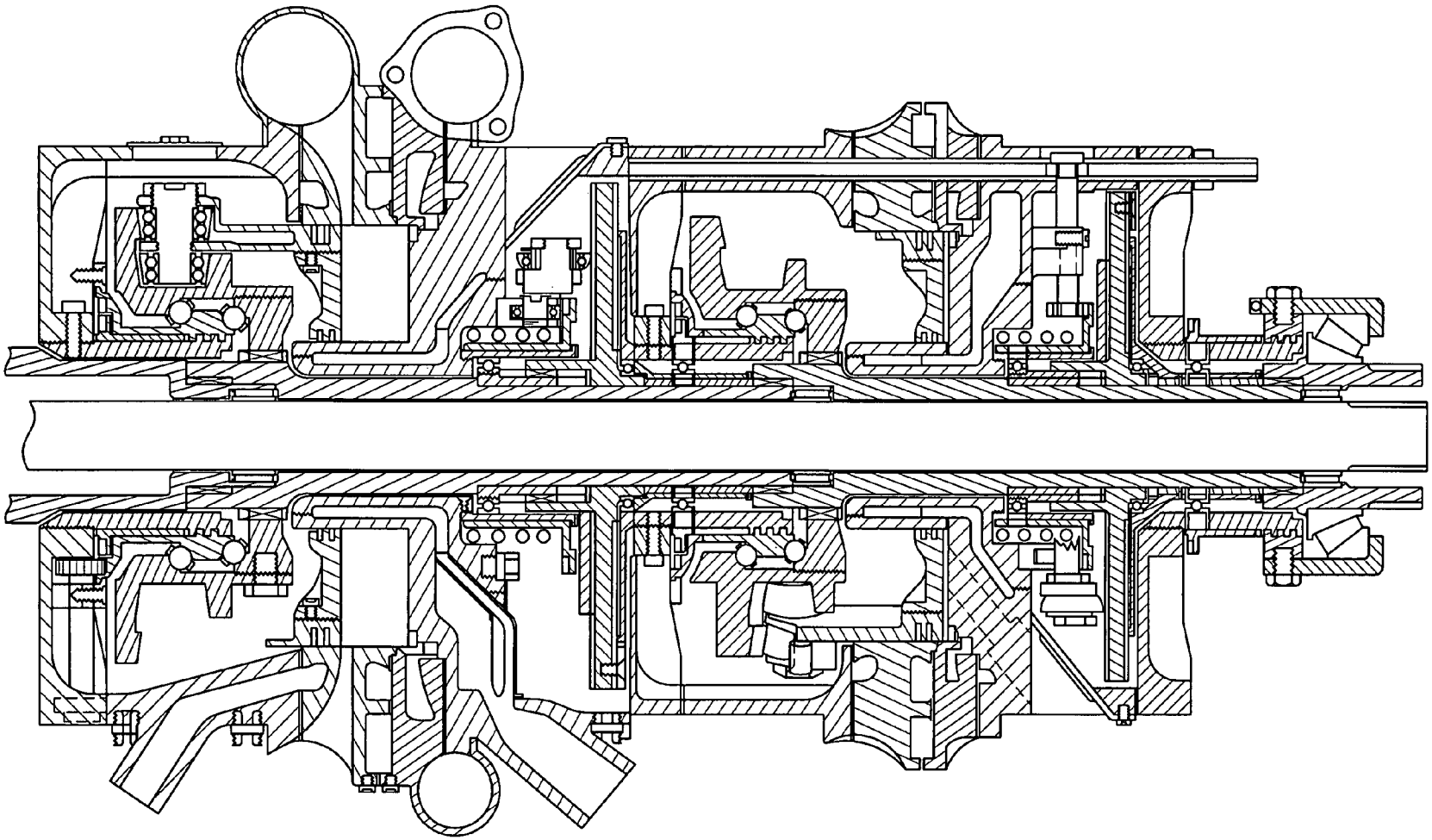
FIG. 11 is a comparative view of portions of the engine shown in FIGS. 1 and 3 demonstrating a proportion of a minimum number of cylinders to avoid balancing problems.

FIG. 5 is a partial, sectional view taken along line 5—5 of FIG. 1 showing a system for the variation of the pressure under a cover of the cylinder head. FIG. 6 is a partial, sectional frontal view of an engine of the present invention taken along line 6—6 of FIG. 1 and showing a structure with tappets engaged with a connecting portion. FIG. 7 is a side sectional view taken along line 7—7 of FIG. 6 that shows stems and relative connecting paths. FIG. 8 is a side sectional view taken along line 8—8 of FIG. 6 showing a tappet and relative supporting structure, e.g., such as ball bearings and the guiding rollers of an annular-shaped piston. FIG. 9 is a partial sectional view taken along line 9—9 in FIG. 1. FIG. 10 is a partial sectional view taken along line 10—10 in FIG. 1. FIG. 11 is a comparative view of portions of the engine shown in FIGS. 1 and 3 demonstrating a proportion of a minimum number of cylinders to avoid balancing problems.

Figure 12:
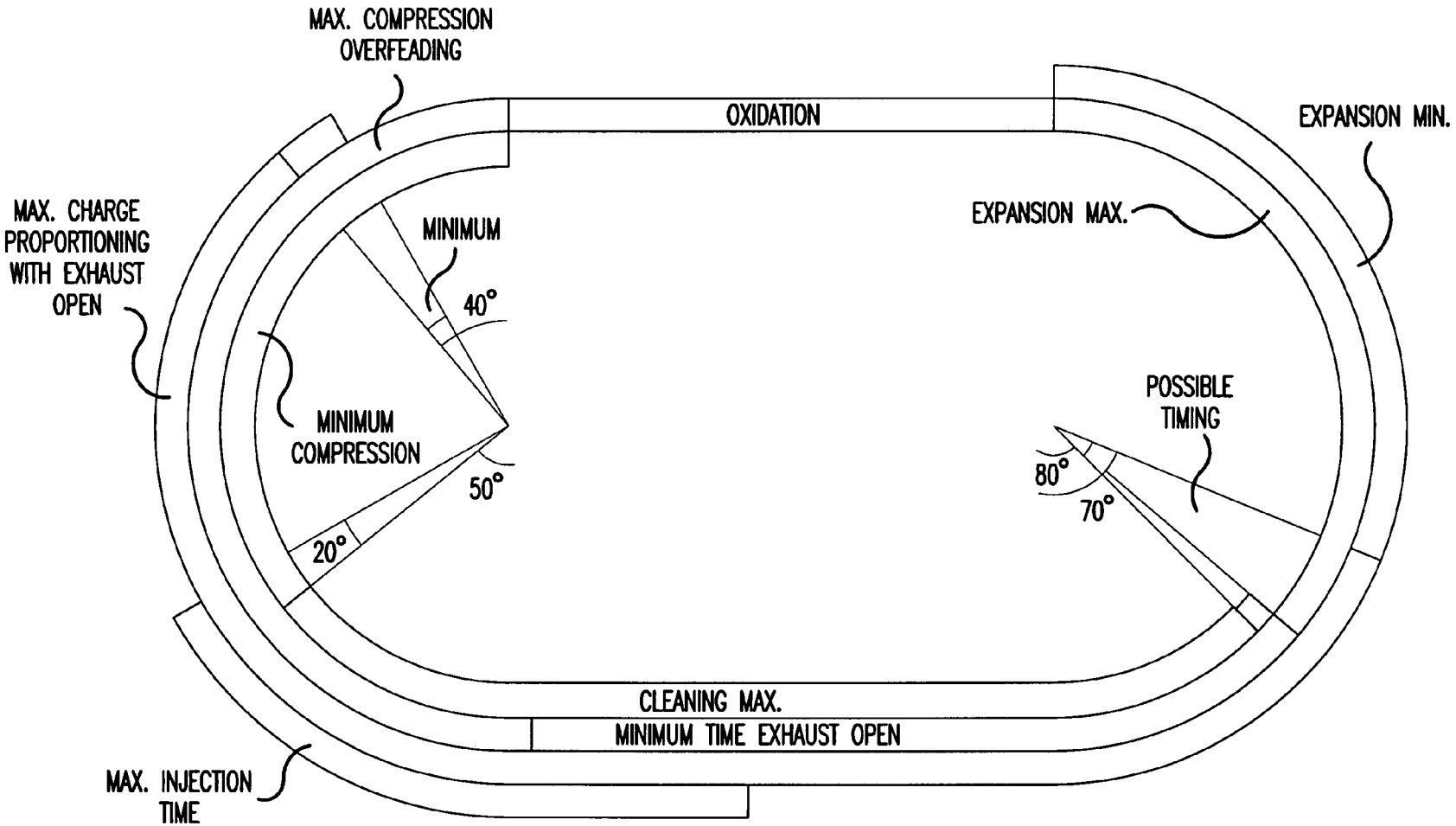
FIG. 12 is a timing system diagram of an operating sequence of the engine of the present invention, including an intake step, a partial exhausting step, an injection step, an oxidation step, a scavenging phase, an expansion phase and a compression phase of eventual supercharging.

FIG. 12 is a timing system diagram of an operating sequence of the engine of the present invention, including an intake step, a partial exhausting step, an injection step, an oxidation step, a scavenging phase, an expansion phase and a compression phase of eventual supercharging. For a correct reading of the diagram, the rectilinear parts of the oval of the graphic represent the positions of the pistons towards the top and bottom dead center positions, e.g., to be more clear and to make a direct and more meaningful comparison with a four stroke engine. The real degrees of the revolution of the engine shaft are 4.5 times so the standstill of the pistons if in reality of this case continue for 20° degrees of revolution, they must be considered equal to the time that a four stroke needs to do 90° degrees of revolution, so an entire operative cycle is represented on the graphic in 540° degrees. However, the real amount of degrees of the shaft is only 120° degrees, i.e., with a complete rotation of the engine shaft three operative cycle are completed.

Figure 13:
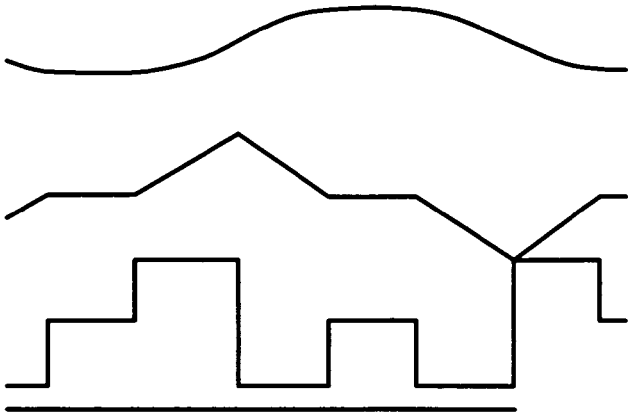
FIG. 13 is a graphical view of a low of the motion with relative accelerations and velocities of the piston for about 120° degrees of rotation of the engine shaft.
Figure 14:
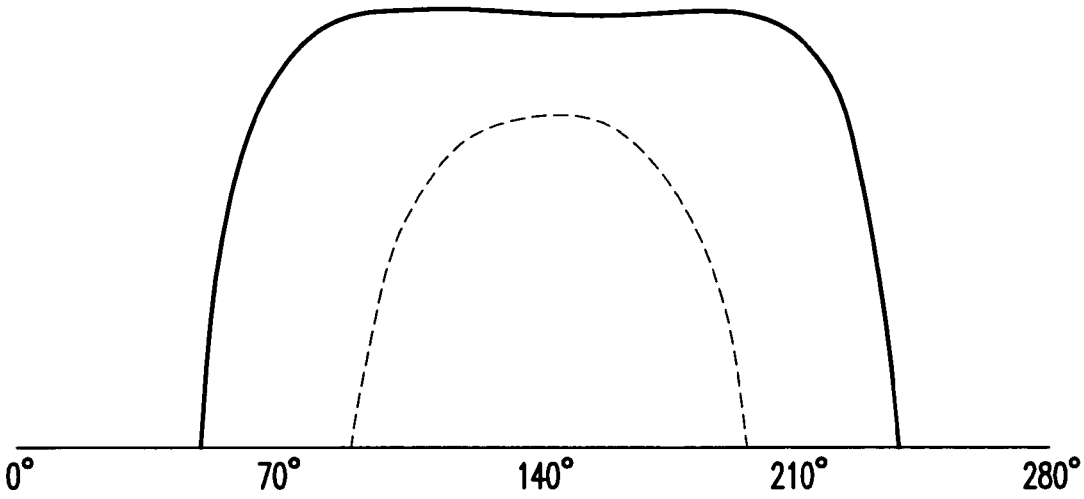
FIG. 14 is a graphical view showing a difference between an instantaneous flux coefficient of a two stroke (dotted line) engine and an instantaneous flux coefficient of the intake of the engine of the present invention.

FIG. 13 is a graphical view of a low of the motion with relative accelerations and velocities of the piston for about 120° degrees of rotation of the engine shaft. FIG. 14 is a graphical view showing a difference between an instantaneous flux coefficient of a two stroke (dotted line) engine and an instantaneous flux coefficient of the intake of the engine of the present invention.

The difficulty, never surmounted, of the direct injection of gasoline in two stroke engines includes the insufficient vaporization of gasoline. In contrast to the use of gasohol that can be burned in very small drops, gasoline must be transformed into a vapor in order to burn properly. This vaporization needs a certain amount of time and the administration of some heat to effect the phase change. With respect to the necessary heat, the direct injection in the combustion chamber offers a hotter ambient temperature than the duct of the intake. For the amount of time needed to vaporize, that is not sufficient in the traditional two stroke engine there are 100° degrees of revolution available, e.g., about 2 milliseconds at 7500 rpm. Some designs apply the solution to premix with compressed air the gasoline, or utilize higher pressure of the injection, to obtain a better pulverization of gasoline.

In this engine the amount of time useful for the vaporization is almost 2.5 times longer, as it is easy to deduce from the diagram of the timing system, e.g., FIG. 12, that shows disposal of an arc of 240° degrees to be used starting from the closing of the exhaust and 20° degrees after the top dead center (TDC) point before the spark fires.

The fundamental aspects of the engine of the present application can be cleared also by what follows. The principal reasons that do not allow the normal two strokes engines to activate a high mid-pressure, e.g., when compared to four stroke engines, is due to the following factors. This is because the dimensions of the holes of the intake, necessarily small because there is the need of sufficient lateral space for the holes of the exhaust that must avoid the vertical extension mortifying excessively the exploitation of the expansion in four stroke engine the valves are very large.

The cleaning phase is not proper at all phases of revolution and to all charges, because of the throttling made from the duct of the intake. Accordingly, part of the exhaust residues in the combustion chamber cause an amount of problems to the oxidation, e.g., this happens in smaller proportion in the four stroke engine. Losses of gasoline from the exhaust due to failure to achieve injection after the closure of the exhaust holes, unless the direct injection is utilized, that for using high pressures and expensive devices that anyhow can help little at high rotation operation, considering the reduced time remaining for the vaporization of the gasoline (the four stroke engine on the contrary has a lot of useful time to effectuate the vaporization even with the direct injection).

Reduction of the exploitation of a part of expansion because of the anticipated opening of the exhaust hole that is settled in a high position on the cylinder, in correspondence of which the piston receives still a strong pressure and the connecting rod pushes on a crank of the shaft that generally has a position of 70° degrees as regards the inferior dead point and "pushes" still in an efficacious way. In a four stroke engine the proportion of this problem is less heavy due in part to the delay of the opening of the valves that begins at about 60° of angles of crank of the shaft as respect to the inferior dead point; it's like having in the two stroke engine about 15% of useful stroke missing, if compared with a four stroke engine of the same displacement.

All these negative aspects of the traditional two stroke engine are solved by the engine that is described hereinafter with a preferred form of realization that from now on will be called NEVIS (New Exhaust Valve and Intake System) to simplify. In NEVIS, the holes for the intake and for the exhaust are of a much bigger proportion than the ones in the classic two stroke engine and they are twice that of the four stroke engine. Also, the flow coefficient is considerably higher, so there are no problems under this aspect for the fulfilling.

The scavenging of the NEVIS differs from the traditional two stroke engine, in that it is very clean and also very easy to regulate at all rpm and at all charges for an optimal expulsion of all the residues of the combustion may be even better than the four stroke engine, especially at partial charges, e.g., due in part to the variable lifting law of the exhaust valve and due in part to their regulating timing system. In the two stroke engine this problem assumes unacceptable proportion. The NEVIS also provides time for vaporization that is 2–4 times longer than the normal two stroke engine.

Considering the relative height of the intake holes and considering that the opening of the exhaust, compared with a normal crankshaft, begins at 55° degrees of angle of crank with respect to the inferior dead point there are no losses of pressure at the end of the stroke like in the classic two stroke engine and it is possible to do better than the four stroke engine. But the most important advantage for NEVIS is surely the reduction of losses of work for the cleaning phase considering that are used energies destined to be lost from the exhaust. The reduction of losses cannot be achieved in either the two stroke engine or the four stroke engine, that on the contrary need to spend a large amount of energy to pump away the residues of combustion one for the pump action and one for the two added strokes.

For all this reasons it should be clear that it is an error to consider the single cycle of the four stroke engine two times more efficient than a single cycle of NEVIS, like it generally happened when the normal two stroke is compared to the four stroke. In only one cycle, the NEVIS can give a mid pressure highly superior to the single cycle of the two stroke engine and only pessimistically equal to the four stroke engine cycle, while at partial charges and low rpm. The four stroke engine is not capable of sustaining this comparison, due in part to the fact that the compression ratio can be modified during the operative cycle.

NEVIS is essentially a two stroke engine that repeats the cycle three times in one revolution of the shaft. The four stroke engine completes an entire cycle in two revolutions of the crankshaft and when compared to NEVIS, a four stroke engine which revolutions are six times faster. If truly the comparison desired is between two monocylindrical engines, even though a more rational comparison is with a three cylinder that has double rpm and a unitary displacement that is equal to the single piston of NEVIS, being obvious that a revolution six times faster would cause excessive mid velocity of the four-stroke piston. Anyhow the comparison between monocylindrical engines can offer a clear and even more evident demonstration of the superiority of NEVIS For example, about the important parameters of the times needed for the vaporization, and assuming a proved data of the times of vaporization of the actual four stroke that means 8 milliseconds at 6000 rpm (300° degrees of engine shaft revolution) surely more that the 5 milliseconds of second that are at NEVIS disposal at maximum rpm, that means at 2000 rpm, but for what said before, having NEVIS at 2000 rpm, twice the number of cycles of the four stroke engine that turns at 6000 rpm, it is necessary to double the turns of the four stroke engine to have a correct condition of comparison between monocylindrical engines, in this case the four stroke engine would have only 4 milliseconds of second of time to vaporise, and that is the 20% less than NEVIS, that probably becomes the 40% of the calculus of the experimentation on the branch of the new "two stroke", will foresee the effective shift of the fuel and of the motion of the charge in the combustion chamber, exactly like the four stroke engine takes advantage of this, will make possible to anticipate of a percentage of time that will be approximately at a 20% of degrees more, this if the comparison is with the monocylindrical engine whose revolutions is six time faster, but let's examine what is obtainable if the comparison is more reasonably between a four stroke engine three cylinder of the same unitary displacement whose revolutions are only doubled.

For what exposed before the useful time for the vaporization in the four stroke engine should be almost two times superior, but in this case the difference is given by the enormous friction and the dispersion of heat on the vast surfaces of a three cylinder that has much more importance of the vaporization times if the engine efficiency is the principal aim and if the rotation NEVIS are around 2000 rpm, as needed for a normal propeller, there is no need to have longer times of vaporization than NEVIS possibility (in formula 1 has been cleared that with direct injection 4 milliseconds of second are more than sufficient to vaporize), anyhow because of the adoption of three injectors with only 50 bar of pressure in order to better atomise and to reduce conspicuously the time needed for the vaporization and considering that the injection happens prominently during the moments in which the pressure in the cylinder is inferior or equal to the atmospheric and the velocity of the air is considerable, due to the swirl caused from deflectors, that are all around the opening of the intake, the velocity of vaporization and of the drops increases and it should not be forget that the combustions happens in a constant volume and in an optimal pressure due to the stops of the pistons at the dead points, all this facts are positive also for the difficult vaporization of those cases in which at high rpm corresponds very small charges, in fact if on one side the delay of the opening of the injectors (that should not inject if the exhaust is open) absorbs time at the vaporization on the other side the variable compression ratio is of a bigger help and results more useful than other devices because the very close positioning of the piston towards the head of the engine, causes a strong squish effect together with a concentration of all the charge towards the space under the spark plug, reducing drastically the space that the flame front has to cover in the time necessary for a complete oxidation, that now needs less time, that for can start later, giving back time to the vaporization of the charge, that being minimal at low charges has reduced injection times and this allows another adding small amount of time for vaporization.

About the movement of the charge in the combustion chamber, swirl, squish, tumble and also the relative intensity of the injection, these are things that normal engine also have, but it was correct to underline that also in the new two stroke engine is possible to have this positive aspects like in the traditional engines and that not a single aspect has been neglected while inventing this engine, indeed the many possible drawings of the head of the engine and of the top of the piston give more chances to this engine than to the traditional four stroke engine, that is limited by the cavities for the opened valve, the irregular band of squish and the absence of symmetrical flow from intake also typical in the "two stroke", for all this they are potentially less optimizable under this aspects.

In the new engine it is possible to regulate, as explained, in a continuous manner and in all range of functioning, the depression of the exhaust due in part to which the cleaning phase can be done, this depression is much more important than the depression that is present in the combustion chamber of a four stroke engine, during the crossed openings of both the intake and the exhaust, the air is called in the combustion chamber more quickly and there are no risks of an exaggerated slowdown of the air coming in, so that in all using conditions it is possible to have useful velocity of the air for the fulfilling and for the conservation of a good amount of kinetic energy, that sustain the movements of the charge (swirl, squish and tumble), that are so useful for a correct and fast combustion.

The fact that the piston has a very limited mid velocity, must not give the wrong idea of a slowdown of the movements of the charge, in fact the time used from the piston to compress the charge is not longer than the one of the compared four stroke engine, as a matter of fact the piston moves the same quantity of charge in the same time and in the same volume or even smaller.

Also the combustion, happens in the same amount of time or even less than in the four stroke engine and happens in a volume much smaller and constant like sabathe cycle determines, in a condition, so in which the front of the flame does not find variation of pressure and a more uniformed temperature together with a turbulence, caused from the squish, always present at all charges and at all range of rpm due in part to the variation of the compression ratio that makes closer or farer the squish band from the head like it is needed.

In all engines exactly during the combustion which is the most hot phase, happens in proportion the biggest transfer of heat to the walls of the cylinders, in the new propulsor the midvolume smaller in this phase, is added to the utility of being able to reduce more at partial charges the volume of the chamber due in part to the variable compression ratio, and considering that for a good part of the life of an engine partial charged are used, reducing the volume of the chamber more than the surface/volume ratio, during these phases results more important not only to reduce the losses of heat from the walls (that become less ample), but also to obtain a good mid pressure.

It is not correct to think that the piston creates during his stop at top dead point, that this advantage of a bigger loss of heat, because the time of the combustion or the velocity of the front flame do not grow up, so we do not have a long time of dispersion of heat, but simply a smaller volume of the combustion chamber during all the combustion. The more uniform temperature in the combustion chamber allows anyhow the adoption of compression ratio medially higher at all rpm and at all charges, this for the ulterior advantage of the entire volume and of the walls interested from the dispersion of heat; also during the phase of expansion that it lasts for shorter time than the phase of expansion of the traditional engines (that for the constant acceleration of the piston in NEVIS), we lose obviously less heat.

It can seen like that short one stoke like NEVIS one is not worth to obtain optimal results in terms of consumption, in fact generally he most the parsimonious engines (and also with less specific power) have generally strokes particularly long, but the reason why such a short stroke has been adopted, is not due only to the need to have freedom of a high specific power, but also to a multitude of factors that give the possibility anyhow to reduce consistently also the consules, combining also prerogatives of reduced alternative forces and more compact dimensions of the engine.

In fact the traditional engines with relative long stroke permit if a cylinder displacement and a number of them is equal to have some advantages essentially from a thermal point of view, like the concentrate form and so a high rendering of the combustion chamber, but this is a small thing if compared with what NEVIS can do and for what before exposed about thermal dispersion and for the volume in which the combustion happens, but also for the more favourable surface/volume/ratio of the combustion chamber even in the phase of maximum expansion that still maintaining a high functionality for the cooling (as better cleared after) it offers an inferior dispersion from the whole of the chamber in comparison to a classic three cylinder four stroke that for equity should be compared if reasonably the mid velocity of the traditional pistons are sufficiently low and that naturally are exposed to the cooling, together with cylinders, for a time that is at every cycle doubled in comparison to NEVIS (the four stoke has losses in the four stroke too).

Why in the NEVIS as said before, the cooling is more efficient standing the reduced dispersion of the heat? The reason is as simple as intuitive: If you try to cool down the center of a piston you must absorb a great amount of heat from the periferic part of the piston until you obtain progressively the temperature desired at the center of the piston, but at that point the periferic parts will be at a temperature much lower than the one in the center and this against the fact that the periferic structure is much stronger than the center of the piston, you have, in other words, an excessive heat absorbing in the periferic part to maintain cool the center of the piston. This does not happen with the toroidal piston because the center of the piston is directly cooled, like the periphery, from the cooling liquid, so the heat absorbed in the periphery can be calibrated without exidings standing the absence of a center, and without having the risk to find some points hotter because of the interference with other structures or with other cylinders that in normal engine are one between the other while in NEVIS they are axially one the other and well separated.

It is now necessary to describe hydrocarbons (HC) at the exhaust, indubitably one of the presence of HC is caused from the unoxidated part of charge that is in the thin part right up the first segment (crevices) and in the toroidal this thin part is much more extended than in the common cylinder, but as already said it is only one of the causes, that must be added to other ones that in the described engine are less influent in comparison with normal engines and probably give substantial reductions not increments of HC. In fact, in the traditional two stroke engine, the concentration of HC rice particularly high levels because the mix of air and gasoline highly rich during the washing phase is mixed in the combustion chamber with the residues of burned gases and with this part of the gasoline comes out from the cylinder without burning; in the new engine this does not happen because during the washing phase there is still no gasoline in the chamber and at the end of the washing phase only clean air remains that can be mixed with the injected gasoline in a correct stoichiometric ratio and compression ratio and nothing can escape from the chamber because the exhaust is closed.

In the normal four stroke, on the contrary, even though there are not so ingent losses from the exhaust (unless you have strong crosses between the opening of the intake ad of the exhaust) the concentration of HC reaches particularly high levels when the engine works with strong depression in the intake duct (that happens at minimum rpm and during the deceleration) because the fuel is very rich of gasoline the expulsion of the burned gases is even less complete and the compression ratio is very low.

In the other condition of functioning the presence of HC in the exhaust gas is due to an incomplete combustion of the fuel in the substrate attached to the walls of the combustion chamber at a lower temperature than the one in the which the reaction of oxidation can happen; this is a function of the mid temperature in the combustion chamber that has said before, talking about surface/volume ratio, in the new engine it is uniform and more elevated, particularly around the exhaust valve, that represents one of the walls of the crevices upon the first segment before mentioned, the wall is not surrounded externally from the cooling liquid, that is why there are less heat losses from the chamber and so to reduce the substratum before mentioned.

Ultimately there are many possible solutions to eliminate further the HC, thermal reactors and various catalytic can help, but what is truly useful is the consistent reduction of the problem at his origin, and that means a correct and complete combustion in all the range of function; the prerogatives of the new engine, due in part to all the possible regulations make this concretely actual, and taking the suggestion from the studies developed from the famous Austrian company of research and development AVL, in terms of emissions close to 0, interesting prospective are suggested in this field, being possible for the engine the hybrid functioning with emphasis by compression but with injection of gasoline and not gasohol, this can be obtained due in part to the variable compression ratio that permits to control the high peaks of excessive pressure.

This is with all probability, the way for the future to obtain very low emissions and this is even more important if it is considered the urgent necessity to give adequate answers to the impositions of the new and severe laws of the immediate future. The versatility of the engine offers the opportunity to easy interest to many sectors together with the aeronautical one. This is an important evolution that gives further guarantees for the commercial success. It doe not exist in fact any previous historical example of complete modularity that includes also the block, so you are free to add as many units you like, ranging, in this way, from minimum displacements and powers to big horse power, maintaining unchanged all the prerogatives of efficiency, durability, low costs etc.

The adoption of a hollow shaft permits to use a transmission shafts, or passing axles, in the shorter version of the engine with two or three cylinders, dedicated to the automotive field; it is possible, in fact, to draw the friction and the gear around the differential, putting the cylinders at the sides of it that with the passing axles passing through the cavity of the engine shaft, can give the motion directly to the moving tires. If the space is not sufficient or more cylinders are needed, it would be possible to put than the engine and the differential longitudinally lengthwise the car, dividing in this way the couple to the anterior and posterior axles without the need of gears, reducer, shafts, or else.

It is anyhow possible the use of the engine with 2, 3, 4 or 6 cylinders, in a traditional way combining a clutch and a gear box directly to the engine shaft. In the aeronautical applications, this engines even more evident advantages considering the weight and the reduced frontal section, but also the very high specific power together with the low consumption.

In the version with 3 cylinders 1500 cc. the power and the couple obtainable are even greater than the ones of a four stroke with 8 cylinders and a displacement of 4000 cc, it must be underlined that all this is one with the half of rpm and for that there are no needs of gear redactors for the propeller.

A considerable vantage is the possibility easily adopt to counter rotating propellers by putting inside, also in this case, a transmission shaft in the cavity of the engine shaft and inverting with gears on the back the rotation, or, in case gears are not desired, because of the increment of friction, you can make two engine work in the two possible rotating senses, in an independent way, and giving the motion to one of the two propellers directly and to the other with a shaft passing through one of the two engines. There are several possible applications, also in nautical field and on aircraft.

Particularly WIG (Wing In Ground -effect) or ecranoplants, that are considered of immediate diffusion, the necessity to have a high power during the take off, but a far less powerful push during the normal cruising creates the conditions for NEVIS to be only possible choice, considering that the optimal efficiency remains also at partial charges. It is reasonable to find out a specific consumption much lower, considering that there are half of the strokes, that there is reduction of friction because of the reduced number of segments, the utilization of the kinetic energy of the exhaust gases that would otherwise be loosed, the exploitation of a bigger expansion, particularly at partial charges, the optimal compression ratio at all rpm and a1 all charges and that will be more elevated than the optimal compression ratio of traditional engines, due in part to the uniformity of the temperature of the head; in eventual automotive applications also the elimination of the gear for the reduction at the transmission and the elimination of the transition itself that originate a considerable absorption of the 30% of the power available for the tires.

There are remarkable advantages from an industrial point of view, and for the low production cost and for the commercial facilitations of a competitive product, but also for the reduced investment needed for the industrialisation itself that are not encumbered by the necessity of sophisticated process or unusual machinery.

Structure of the System for the Transformation of the Alternate Motion in Rotary Motion Unless otherwise indicated, the following detailed description is referring to FIG. 1 of the present application. In the illustrated form of realisation has been introduced a support substantially cylindrical (2), that surrounds the engine shaft (1) which is coaxial and solid in the rotation. The support (2) is provided of two protrusions or profiles (3–4) that surround it all around with a cyclic undulating course. Between the two protrusions, (3–4) three couples of ball bearings operate (5–6) attached to three supports (27), that are part of a piston (7); the ball bearings (5–6) are bind from the same supports (27) to move only in parallel with the axis (0—0) of the engine (1), that for when they are pushed from pistons (7) on the undulations of the profiles (34), the resulting force, applied at the point in with the ball bearing (5) are in contact with the protrusion (4), imply the rotation of the support (2) and for this the rotation of the engine shaft (1).

Vice versa, when is the support (2), on the engine shaft (1), to set the motion to the ball bearings (5–6) with his rotation, ball bearings in their alternative movement, will follow the accelerations and the decelerations caused by the undulations of the profiles (3–4) that are coherent to a curve that has a rectilinear course at the tops in order to permit the standing of the pistons for a certain while at he dead points. The same curve implies to the ball bearings (5–6) constant acceleration and deceleration during their alternative motion. Naturally, whether is the engine shaft to drive the pistons motion or otherwise, one of the two profiles (3–4) is used to push, the other one to call back ball bearing (5–6), similarly the ball bearing (5–6) invert the task one to push and one to decelerate the piston at every stroke.

The profile (3–4) developed on an even surface of the velocity of the piston (7) and the accelerations of itself, are represented graphically in FIG. 12 where, for simplicity, it has been considered only one operative cycle, while in reality the cycles are three for every revolution.

It is possible to easily vary the compression ratio causing a minimum axial movement parallel to the axis (0—0) of the support (2) on the engine shaft. The movement can be regulated in an extremely precise way with a screw (8) that recalls or pushes away the ball bearing (9) with doubled balls that fixes the support (2) to the cylinder (56) attached to the cover (55) of the block (10) and not to the engine shaft (1). With a geared (12) which is independent from the axial movement of support (2) but connected to circular movement imposed by the internal screw (8) of the ball bearing (9), it is easy to control the amount of turns of the screw to obtain the optimal compression ratio; a small gear, engaged with the gear (12) of the regulator that has his axes (14) extended towards the external part of the block (10), can give the possibility to regulate, with a special device to external actuators. The support (2) with the profiles 83–4) is connected to the engine shaft with an internal groove (15) and with an external groove (16) of the engine shaft. There is no need of counterweights of balancing, if the pistons (7) are two, three, four or six. The only vibrations in need to be extinguished, are the torsional ones of the engine shaft (1). A connection with engine shaft via normal elastometers, largely in use, can easily absorb a vast range of frequencies, and, like in traditional engines, the adoption of the vibration redactors it is necessary to avoid the rupture of the shafts for stress.

The shaft one is hollow and has other two grooves (17–18), an anterior and external one (17) FIG. 7 and a posterior and interior one (18) FIG. 1 where a bigger diameter permits the junction with the groove of other shafts of equal engine units that are desired.

Other peculiarities of the shaft (1) are treated in the part that regards the timing system and the part concerning the possible configurations.

Structure of the Piston and of his Ball Bearings

The annular piston (7) can appear at first a strange and little self-defeating choice. It doesn't seem in fact to promise reductions of friction the segments (19, 20) on the external side (19) plus the internal ones (20) on such a piston (7) (it is well known that the perimeter of a circle is much shorter than both the perimeter of a donate covering the same area of the circle). Even less promising seems to be the increased mass, due to the increments of the diametrical dimensions of the annular piston (7). But as often happens for the things that are not immediately intuitive, it is necessary a deeper analysis to make better judgement.

To begin let's compare to the annular (7) a traditional piston, let's say of 86 mm. of bore and with a stroke of 86 mm., for a unitary displacement of 500 cc. A so-called super squared like the more recent applications. The first data says that the surface interested by the friction of segments in the classic piston can be considerably reduced, if the diameter of the piston is enlongated, with respect to the stroke (obviously maintaining the same displacement).

To go other a certain limit by using big diameters with traditional pistons is not convenient because of the problems of cooling the center of the piston, that being far from the cooling liquid is not able to drain all the heat that it accumulates, the thermal efficiency deteriorates because of a bad surface/volume ratio and the time to complete the combustion is longer due to the longer distance that the front of flame has to cover.

For this reasons bores bigger than 80–90 mm. are rarely used in displacements of 500 cc. With the annular piston (7) it is instead possible, to have much bigger diameter, standing the possibility to cool down easily the central part of the piston (21). A surface of the top of the piston (7) around 3–4 times bigger than the piston with 86 mm. of bore, gives the opportunity to reduce the stroke of the piston to 25 mm.

If the diameter of the internal hole of the annular piston is 80 mm., enough to give place to the cooling water (22), to the engine shaft (1), and to the transmission shaft (23), the external diameter of the piston has to be 178 mm., if we wont to obtain a volume of 500 cc. of the combustion chamber (24). In this way it does not exist a point of the piston that has a distance from the cooling liquid bigger than 24.5 mm., like in a classic small piston of 49 mm. of bore.

An interesting surprise, continuing to analyze, comes also from the evaluation of the reduced surface that the segments (19, 20) involve with their alternate motion witch results 20.253 mm.2 against the 23.223 mm.2 of the traditional piston, in other words a 15% bigger surface than the annular.

The exploitation of the expansion of gasses is much bigger especially at partial charges, not particularly due in part to the new piston (7) that doesn't anyway cause worsening against this aspects, but due in part to factors that are more clearly disclosed in the chapter structure of the regulation of the charge.

The oxidizing process, due in part to a long permanence of the piston to the top dead points, has more time to be completed and in a constant volume, but to have a certain symmetry of the pressures of the expansion, of the front of the flame and for security reasons in the aeronautical applications, it is useful to adopt in the planned space (25), three spark plug and three injectors in their correct position (26) FIG. 8 that operate at a relatively low pressure, for the gasoline version), these last ones to prevent also a bad mixture of the fuel in places between them distant in the combustion chamber (24). The adding cost of a spark plug and of two injectors per each cylinder, are compensated by the fact that a single annular piston (7) realizes in the same time a triple number of operative cycles with respect to a normal piston two stoke. In other words it is like having a piston that does the job of three traditional one.

The mid velocity of the annular piston (7), due in part to a very short stroke, remains very slow, in fact at 2500 rpm, the annular piston goes up and down 7500 times per minute, but the mid velocity of the piston is only 6.25 m/s., (eliminating from the calculus the standing time of the piston 8.33 m/s.) against 21.5 m/s. of the piston with the bore and the stoke of 86 mm., that at 7500 rpm with that stroke involves inertias of the piston that are not comparable to the inertia of the annular (7), that even though is more heavy, it has three different point of sustaining (27) instead of one and takes advantage of a stroke 3.5 times inferior.

Also the constant accelerations implied from the profiles contribute to keep maximum velocities of the piston (7) very low, for an ulterior advantage of the inertia FIG. 12.

It must be considered that the low surface/volume ratio of the combustion chamber (24) it becomes an advantage, considering the necessity to draw out a bigger amount of heat due to the increment of the number of the combustions, anyhow the lower temperature in the most critic point, the center of the piston, helps to limit the substraction of heat that on the contrary has necessarily to be very high with normal pistons if you want to cool down the central part of them. It is clear that of this takes advantage the dimensioning of the cooling system but principally makes the engine more adiabatic. The symmetric and uniformly distributed temperature, at the end, helps to prevent near by the intake holes, undesirable deformations of the cylinder (28) which are typical in classic "two stroke".

By the side there are many examples of two stroke engines with driven exhaust valve that under this aspect are durable and secure. If the ball bearings were one up on the other, like on existing engines that have the cylinders axis parallel to the rotating axis of their shaft, the support (27) dimension, would be double, this would be a disadvantage, not only for the masses in alternate motion, but also for the deepness and dimensions of the block (10) that is supposed to be added together with other similar blocks (10) and that for must be quite compact.

The ball bearings (5–6) that are of double ball type, that for of a certain cost, must be necessarily chosen to obtain a correct and secure functioning and allows very hi performances. The adoption of the ball bearing is also to be referred to the chosen kind of lubrication for the engine, that happens due in part to controlled spry, which is better than the traditional because it has less absorbing power, it make possible to eliminate one segment that should be at the short base of the piston (28) which base is able to avoid oil transfers in the duct of the intake (29), a nebulizing system also permits to eliminate periodical substitution of oil, it is possible to eliminate the oil cup that would ruin part of the advantages of this compact engine, that has besides a very low barycenter and the modularity of the engine would necessitate of a plurality of oil cups still worst a plurality of oil pumps.

The ball bearing (5–6), on the other hand, do not suffer for the problem of absence of lubrication during the startup phase. At the end the ball bearing (5–6) are subjected to the same consideration expressed for the spark plug and for the injectors, one annular is like three traditional pistons.

The function of the wall of the piston (28) (the internal part (21) is not provided of a wall) is to be considered of structural strengthens for the annular piston (7) and as a limitation for the oil that is not supposed to enter in the intake, and not as a surface useful to contain the lateral pressures caused by the traditional connecting rod that here are eliminated together with all problems of balancing and of weight.

The annular piston (7) is subjected to forces and couples that cause only rotations on his axis when the profiles (3–4) imply the ball bearings (5–6) to move. To solve it is sufficient to put 6 rollers (30) FIG. 7 and FIG. 8 that have undulated surfaces between opportune guides (31–32) FIG. 8, with equally undulated surfaces and fixed to the sides of the support (27) of the ball bearings (5–6) and on the walls (33) FIG. 8 of the block properly contrasting. The rollers (30) of FIG. 8 have a minimum mass and dimension, force the piston (7) to remain in his axial position and preclude the rotation.

The undulated surface of the rollers (30) FIGS. 2–8, combining with the undulated surfaces of the relative guides (31–32) FIG. 7, will oblige the rollers (30) FIG. 7 to remain always in their working position, rotating only of that half tour that the stroke of the piston (7) alternatively imposes.

The rotation axes of rollers though is not parallel to the rotation axes of the ball bearing (5–6) of the support (27) of the piston (7), in fact being necessary to incline the external surface (34*a*–34*b*) FIG. 3 of the ball bearings (5–6) that are in contact with the profiles (3–4), of about 20° degrees to avoid the wear of the profile (3–4) and of the ball bearing (5–6) itself, there are tendencies of the support (27) of the piston (7), although of small entity, to flex toward the external part of the profiles (3–4).

So to avoid this tendency, also the rollers (30) FIG. 7 and the guides (31–32) FIG. 7 we have a position so that the rotation axes of the rollers (30) FIG. 7 is of about 20° degrees inclined together with the external parts of the support (27) of the piston (7) with respect to the ball bearing axes, in a way that the support is contrasted and a rigid imposition of the motion is guaranteed to the piston (7).

While the external segments (19*a*–19*b*) of the pistons are traditional, the two internal elastic rings of the pistons (20*a*–20*b*) they should obviously tend to contract towards the inside, their hardened face also is internal and they necessitate an accurate definition and experimentation.

It is not necessary to use segments for the oil recall due in part to the kind of lubrication system select, certain holes (35) in the wall (28) provide to drown the oil towards the lowest part of the bock (10) where different holes (36) provided to suck that modest quantity of oil exceeding, due in part to the depression created by two normal external oil pump that have to be selected considering the number of modular engine units desired, the same is for the water pump, for the injector pump, for the gasoline pump or for the gasohol pump.

It is planned, that the piston (7) can interchange the surface of his top (37), and this to have the possibility to choose either the functioning with the spark ignition either the functioning with the ignition caused by compression, that is in need of a thicker top of the piston (37) and foresees under the injectors (this interchangeable to) the cavity useful for a correct combustion.

An internal screw (38), close to the external segments (19*a*–19*b*) enable a secure and easy assembling of the to possible tops (37), the blocking is ensured by two nozzles (39) that contrasting on the screw (38) prevents the unscrewing.

While the interchangeable internal part (37) of the piston can be of aluminium, for the external part (7) materials like the steel are more indicated and have the double advantage of a reduced dilatation and of a hardened cavity for the segments (19*a*–19*b*) that are often subjected to wear if they are of aluminium, more the strengthens needed for the support (27) of the ball bearings (5–6) couldn't be easily reached with the aluminium.

Structure of the Intake

One of the most serious limitations of the normal two strokes is due to the dimensions of the holes of the intake and of the exhaust that have a very modest space on the cylinder walls. In this engine it is possible to have a very vast total surface of the intake holes (29) positioned in the lower part of the cylinder (40), this because the exhaust (41) is in the high part of the cylinder (40) that is obviously annular. To this must be added the fact that the piston (7) stops at the inferior dead point holding in an open position the intake holes (29) for a pretty long time. Consider the instantaneous flux coefficient compared with the flux of the classic two stroke engine, e.g., see FIG. 14

The adoption of a duct with variable geometry could enlarge considerably the range of rpm in which is possible the use of the aspired versions of this engine, this factor results more clearly in the chapter STRUCTURE OF THE REGULATION OF THE CHARGE.

Structure of the Exhaust

The system to effectuate the exhaust is driven, it has an ample surface (41) for the outflow of gasses, coherently to the intake (29) and is developed all around the top part of the cylinder (40), the part that is not tacked by the segments (19*a*–9*b*) in their alternate up and downs, it is an annular fissure few millimeters high, in this case around 4–5 mm., the valve (42) to close is that for annular and it lifts and it shuts down like a guillotine (43) from the point of contact with the cylinder (40) toward the head of the engine (44) and vice versa.

Similarly to the annular piston (7) it is less solicited by the forces of inertia of a lift that is less than the half of the traditional valve lift. It is compensated in this way his bigger mass due to the grown diametrical dimensions, by the side the forces are shared to 6 stems (45) FIGS. 7–9 symmetrically distant in order to avoid undesired flexions of the ring (42).

Particular attention has to be paid for what follows, the siling of the annular valve (42), has to be ensured on the top, with an edge (46) of the valve (42) that is turned towards the inside of the ring (42) and that lies on another edge (47) created in the head (44) of the engine, where a thin annular spring (48) ensures the desired spring force due in part to the form and to elasticity. For the realization of this spring (48), it will be necessary to choose a material that can keep his elastic properties at hi temperatures to, because if it is true that is protected inside the edge of the head, it is possible to have some blow by of gasses that can reach it.

The shape of the spring (48) must guaranty to the valve a variable and hermetic closure at different possible points, considering that is not possible to have a perfect matching of the head (44) with the block (10) and considering that the valve (42) are together with the head (44), if the coupling is not more than perfect, or if you have a lift of the valve (42) from the superior edge (47), it is possible to have leaks, on the other side, if the head (44) is a bit to hi from the block (10), you would have leaks from the low part of the valve (42) that is not able to close all the fissure, because she already tacked the superior edge (47) of the head. With the thin spring (48) before mentioned these problems are avoided, considering that the amplitude of the flexion of the spring will be higher than the amplitude of the tolerance of coupling of the head (44) with the block (10).

Anyhow it is a matter of small flections required to the spring (48) that has to support a relative mechanical strain, so it can be realized with a small and thin band dimension that together with the ample diameter will not have needs of elevated pressure to obtain the vertical deformation desired. The inferior part of the valve (42) does not create particular problems for the sealing, has it can be considered like a valve with a very big diameter, it will be easy so to create a traditional coupling with the point of contact between the valve and the inferior part of the exhaust duct (43), with an inclination of the edge of the contact of 30°–45° with respect to the axes of the valve.

The closure with a certain pressure of the valve will be ensured from a traditional spring (50) considerately large and with a reduced number of spires, calibrated to give sufficient pressure for the sealing in the resting condition and sufficient pressure to bring down the valve (42) after the lift, avoiding the detachment of the tappet (51) from the cams (59) later described.

The contact surface between the valve (42) and the inferior part of the duct of the exhaust (43) will be naturally protected with the same material of the traditional seats of valves. In the same way the superior laying point (46) of the valve (42) on the spring (48) will be protected. The laying point or edge (47) of the spring is unscrewable, due in part to the screw (52), from the head (44) to make possible the disassembling of the valve (42).

The common exhaust valves have a serious handicap, they have to be open towards the inside of the cylinder, that for they go against the normal flux of the exhaust gasses that after having surpassed the valves they burn the stems also.

The temperatures that can be reached are very high in comparison with those of the intake valve. That for it is necessary to use more resistant materials (still with chromium silicium, still austentitic with high tenor of nickel chromium), and often you are obliged to complex realisation, like valve with cavity fulfilled of metallic sodium or lithium potassium salts that transmit better the temperature from the head to the stem of the valve.

All these problems do not afflict the new system for the outflow of the exhaust gases; in fact, during almost all the time of the expulsion of the exhaust, the guillotine valve (42) is well protected in his sit (53) right up on the opening of the exhaust (41), that for it is not exposed to exhaust gases and it does not create obstacles to the normal outflow of them.

The eventual small quantity of heat that would be absorbed when is closed, will be easily drawn through the stems (45) FIG. 7 and through the inferior edge (43) that is close to the cooling liquid (22), like the piston (7).

Six radial deflectors (57) FIG. 7 provide to invite gently curving the exhaust gases toward the annular duct that collects the exhaust and that here is not represented, in order to utilize, more as possible, the kinetic energy of the exhaust. The opening timing can happen in a minimum of 34° of angle of revolution of the engine shaft (1) or maximum 50° of angle (in a four stroke engine this would be equivalent to a minimum of 145° and to a maximum of 305°).

Structure of the Timing System

Up on three ball bearings (51) it is imposed the lifting law of the exhaust (42) by special cams (59). Each ball bearing is pivoted to the angular limbs (49) of a structure (60) FIG. 6 that has three bars united in order to form a sort of triangle that lies with the sides on a unique recalling spring (50) FIG. 6, the same axle (49) FIG. 6 of each ball bearing has place for a ring (62) FIG. 6 that is free to rotate around his axis and is provided of two protuberances (63) FIG. 6 symmetrically displaced on the external part of the ring, where are hanged the extensions of two distinguished oscillating supports (65) FIGS. 6–8 that work on roller bearings (61) FIG. 6, this extensions are very short because the oscillating supports are very close to the relative operating stems (45) FIGS. 6–8 to be lifted and that are provided of special regulating tappets (66*a*, 66*b*) FIG. 6 that are screwed on the stem (45) FIG. 6 and permit to be regulated and fixed.

The necessity to have this ring (62) FIG. 6, free to rotate on his axis, is caused by the difficulty to have a constant and identical regulation of the tappets (66) FIG. 6 of two stems (45) FIG. 6 that are close. With this system if a tappet loses his regulation (in force of the expansion of the stem for instance), the ring (62) FIG. 6 is able to compensate automatically the difference of the laying tolerance between the two tappets (66) FIG. 6 always lifting them in the same time and in the same way.

If two tappets (66) FIG. 6 are lifted at the same time from the ring (62) FIG. 6, than only three rings are necessary to lift all the stems; as a mater of fact there are three rings (66) FIG. 6 coupled with three regulating ball bearings (51) that work as the real roller tappets and obtain a contemporaneous contact between all the ball bearings (51) and all the cams (59). This regulation is made possible by the adoption between the axle (49) and the ball bearings (51) of two concentric and eccentric rings (67–68); that can be counter rotated a few degrees in the opposite senses causing a precise shifting up or down of the roller tappets on their axle (49), than they are blocked by a small nut (69) screwed on the axle (49). This regulation can be done without opening the engine due in part to proper small windows (70) that give easy access.

The choice to adopt the oscillating supports (65) is necessary if you want to eliminate the vibrations caused by the alternate motion of the valve, it resulted necessary to reject the hydraulic tappets, because they can't reach hi rpm and complicate considerably the general structure, being also expensive. The stem (45) are very short and being united but not welded with a quite could valve (42) they shouldn't be subjected to appreciable elongations when the engine rise the operating temperature, anyhow their elongation can be compensated with a regulation of the conic roller bearing (71) FIG. 8 used to hold the engine shaft (1) FIG. 8, at the end of the last engine unit, the lengthening of the stems in any case, do not cause an approaching of the roller tappets (51) to the cams (59), but a gap; that for the regulation of the roller tappets has to be done by putting in contact the roller tappets (51) with the surface (72) of the overhanging disc or flat support (73), obviously in the point where it's flat and not where there are the cams (59), that are the eccentrics of a normal camshaft developed on the plane. This cams (59) are free to move to the external part (73) FIG. 1 FIG. 8 of the support or vice versa; the support (73) is engaged with the engine shaft (1) and has an ample diameter so to permit to the three cams (59) sufficiently extended movements.

The cams (59), opportunely moulded, press contemporaneously on all the roller tappets and the laws of the lifts vary, principally their duration, depending the positions of the cams imposed is more of less periferic on their support (73), while the beginning of the lifting phase can vary due in part to a system that is able to modify the angular position of the support (73) of the cams in comparison with the coaxial engine shaft as much as needed.

This variable timing system is made of a cylinder (74) provided of a groove (75) in his internal part while the external part has an elicoidal groove (76), the cylinder (74) is placed in between the central part (77) of the support (73) of the cams and the engine shaft (1) that are coupled via their respective grooves (78–79) to the cylinder (74); to effectuate the variation of the timing, the cylinder (74) is moved up or down of few millimeters, by a ball bearing (80) welded on him and that again is moved up and down due in part to the adoption on his external part of 4 small pivots (81) FIG. 6 that are inserted in symmetric oblique guiding fissures (82) FIG. 1 FIG. 6 on the curved face of two external cylinders (83–84) concentric between them and the ball bearing (80), one of this cylinders (83) is fixed to the block (10), while the external can be to rotate on his axis, in this way changes the angular position of his oblique fissures (82) FIG. 1 FIG. 4 that are oblique in the opposite sense of the ones on the internal cylinder (83), so the contrasting push of the edges of two guiding fissures, internal and external, applied on each pivot causes a lift or a lowering of all the pivots and of the attached ball bearing (80). The external cylinder (84) is provided, than, on the top part, of a gear (85) engaged with a smaller gear (86) FIG. 8 that has an axle (87) FIG. 8 that transmits the rotation to the external part of the block (10) permitting the regulation of the timing system with extending devices to computerized actuators.

System and Structure of the Regulation of the Charge

The principal innovation of this engine is the system used to vary the needs of charge. The extended opening of the exhaust valve (42) give to the piston (7) the possibility to expel the air that replaced the exhaust gasses with the cleaning phase, the longer is the time the valve (42) stays open the smaller is the amount of air that remains for the successive operating combustion and being possible to vary the compression ratio, it is possible to have really small quantities of air charge. In other words we reduce the charge but not the efficiency of the engine that utilize entirely the expansion of the combustion with an expansion stroke that results very long in relation to the small charge.

Vice versa if the opening time of the exhaust valve (41) is short and the air entered is not allowed to get out from the exhaust duct (41), the compression ratio can turn back to the initial proportion, that for, remarkable charges can be reached, especially if the inertia of the air in the intake duct originates some overriding. It is better though, to be coherent with the attention paid to efficiency until now, not to feed with to high pressures the engine, because this needs higher depressions in the combustion chamber that can be obtained only using the kinetic energy of the exhaust gasses that, getting out with hi velocity, cause depressions as intense and durable as long lasting and consistent is the outflow of the exhaust, so anticipating the opening of the exhaust valve when is still present a certain pressure in the combustion chamber improves the fulfilling, but causes a loss of efficiency because it is not used entirely the pressure created by the expansion of the combusted gasses.

In those cases in which turbine compressors are adopted, or passing from the gasoline version to the diesel version, it will be possible to reduce or increase the compression ratio as needed, by programming again the hardware that assist the actuators of the timing and of the variable compression ratio system, so to make possible to regulate the needs of charge in an optimal progression, with the various possible opening laws of the exhaust.

The cams (59) FIG. 8 move on their support (73) FIG. 8 to effectuate the acceleration: also in this case like in the system for varying the timing, a ball bearing (88) FIG. 8 with four pivots (89) FIG. 8 symmetrically welded on the external part and four pivots (90) FIG. 8, symmetrically welded inside, can move up and down coaxial and in parallel with the engine shaft (1) of about 4 cm., the internal pivots (90) FIG. 8 are inserted in oblique guiding fissure (92) FIG. 8 of a cave cylinder (91) FIG. 8 that is internal and concentric to the ball bearing (88) FIG. 8, the four pivots (90) FIG. 8 traversing the openings are inserted then in the groove of the engine shaft (1), while the pivots move up or down together with the ball bearing (88) FIG. 8, they contrast the oblique fissure (92) FIG. 8 and cause a rotation of the cave cylinder (90) FIG. 8 of 90° on the lower part of this same cylinder (91) FIG. 8, a part close to the support (73) FIG. 8 of the cams (59) FIG. 7 to be clear, is welded a disc (94) FIG. 8 and also this one is provided of oblique fissures (95) FIG. 8 that guide the pivots (96) FIG. 8 that are fixed this time on the opposite face of the mobile cams (59) FIG. 7 that are driven by the rail (97) FIG. 8 of their support (73) FIG. 8. The pivots (96) FIG. 8 are pushed from the guiding fissure (95) FIG. 8 towards the outside or the inside of the support (94) FIG. 8 with the cams (59) FIG. 7, without having centrifugal complications, because the guiding fissures (95), degrade towards the center of the disc (94) FIG. 8, fixed under the cylinder (91) FIG. 8 before mentioned, with an acute angle and like a spiral.

The external pivots (89) FIG. 7 of the ball bearing (88) FIG. 8 differently, are inserted in other two concentric cylinders (56–99) FIG. 7 these two also provided of fissures (100) FIG. 8, one cylinder is fixed to the cover (55) FIG. 7 of the head (44) FIG. 8 the other one is rotating and provided of a gear that when is rotated via another small gear engaged with it and provided of an extended axle toward the external part of the cover (55) FIG. 7, happens to obtain the movement up or down of the ball bearing (88) FIG. 7, that causes as said the rotation of the disc (94) FIG. 7 and FIG. 8 that moves the pivots of the cams forward or backward.

Timing System Diagram

The diagram of the timing system of the engine see FIG. 12 represents one of the possible diagrams o the timing of the operative timing phase of the admission, of the overfeeding, of the charge proportioning, of the injection, of the compression, of the combustion, of the expansion, of the expulsion of exhaust, of the cleaning. For a correct reading of the diagram, it must be remembered that the rectilinear parts of the oval in the graphic, represent the standings of the piston to the top dead point and to the low dead point; to be more clear and to make possible a direct comparison with the four stroke engine the real degrees of the rotation of NEVIS shaft have been expanded 4–5 times, that for also the standings of the pistons that happens during an angle of the shaft revolution of 20° degrees, is represented in the graphic expanded in 90°, so an entire cycle happens on the graphic in 540°, while in reality the degrees of the angle of the shaft rotation are 120°, that means that with one complete rotation of the shaft three operative cycles are executed. The combustion chamber (24) of 178 mm. of bore, the three spark plugs are symmetrically positioned at a distance so that the farthest point that has to be reached from the front-flames, is of 77.5 mm., that is not a lot but not so little considering that is the 45% more in comparison with the traditional combustion chamber of 86 mm. of bore with the spark plug positioned in the center, anyhow this difference assumes relative importance considering that, due in part to the standings of the piston, the front of the flame has almost triple time to cover the 77.5 mm. of distance (comparing with the four stroke engine the duration of the spark-advance is like having 150° instead of 60° of angle of rotation of the four stroke engine shaft.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for controlling the compression ratio in an internal combustion engine, said internal combustion engine having an engine shaft and an operation cycle that includes at least one exhaust and cleaning phase and one intake proportioning and compression phase in a combustion chamber of the engine, an engine intake system, an engine exhaust system having a duct and at least one exhaust valve in said duct for removing exhaust gases from said combustion chamber, and a timing system to control opening and closing of said at least one exhaust valve said method comprising:

keeping said at least one exhaust valve opened for an adjustable time length in an initial part of said intake, proportioning and compression phase;

entering an amount of fuel corresponding to the amount of air remaining in the compression chamber after closure of said exhaust valve in a subsequent part of said intake, proportioning and compression phase.

2. The method according to claim 1, wherein the internal combustion engine completes three operative combustion cycles in only one revolution of the engine shaft.

3. The method according to claim 1, wherein the internal combustion engine has only one cylinder.

4. The method according to claim 1, wherein the internal combustion engine has a plurality of cylinders.

5. The method according to claim 1, wherein the internal combustion engine includes at least one annular shaped piston.

* * * * *